United States Patent [19]

Jones

[11] 3,964,855

[45] June 22, 1976

[54] TUBULAR SPINNERETTE ASSEMBLY

[75] Inventor: Maurice J. Jones, Decatur, Ala.

[73] Assignee: Monsanto Company, St. Louis, Mo.

[22] Filed: Aug. 19, 1974

[21] Appl. No.: 498,355

[52] U.S. Cl. ..... 425/463; 425/464

[51] Int. Cl.[2] ..... D01D 3/00

[58] Field of Search ..... 425/461, 462, 463, 464, 425/131.5; 264/176 F

[56] References Cited

UNITED STATES PATENTS

| | | | |
|---|---|---|---|
| 3,174,184 | 3/1965 | Calaway | 425/463 |
| 3,335,210 | 8/1967 | Vinicki | 425/464 X |
| 3,451,102 | 6/1969 | Chomitz et al. | 425/464 |

FOREIGN PATENTS OR APPLICATIONS

| | | | |
|---|---|---|---|
| 106,404 | 1/1967 | Denmark | 425/461 |
| 1,077,128 | 3/1960 | Germany | 425/461 |
| 489,636 | 11/1970 | Switzerland | 425/464 |
| 489,637 | 11/1970 | Switzerland | 425/464 |

*Primary Examiner*—Robert D. Baldwin
*Attorney, Agent, or Firm*—Robert L. Broad, Jr.

[57] ABSTRACT

A spinnerette comprising a hollow spinning element having therein a plurality of radially extending spinning apertures positioned in arrays extending around the periphery of the element. A spinning composition forced axially into the spinning element through the ends thereof is extruded by the orifices in radial directions to form filaments.

1 Claim, 4 Drawing Figures

TUBULAR SPINNERETTE ASSEMBLY

BACKGROUND OF THE INVENTION

Conventional spinnerettes for the production of man-made fibers usually take the form of a thin disc which may be flat or slightly convex, with the spinning orifices extending in arrays across the face of the disc. The spinnerette disc is secured around its edges to a spinning head, the spinning head and a spinnerette forming a chamber into which a spinning composition is pumped under pressure. Filaments are formed as the spinning composition passes through the orifices in the spinnerette. One of the primary disadvantages of this spinnerette is that, as the diameter of the spinnerette is increased, the tendency of the spinnerette to bulge under pressure increases. For this reason, the diameter of the spinnerette cannot be increased beyond a certain value without excessive bulging. This, of course, puts a limit on production of filaments from a spinnerette of this type.

FIELD OF THE INVENTION

This invention relates to spinnerettes for extruding fibers.

SUMMARY OF THE INVENTION

In this invention a tubular spinning element is provided with spinning orifices extending radially from the axis of the element. A tubular member supports the spinning element and is provided with openings positioned to expose the spinning orifices so that a spinning composition forced into the spinning element along the axis thereof is extruded into fibers in directions radially extending from said axis.

DETAILED DESCRIPTION OF THE INVENTION

Figure 1:
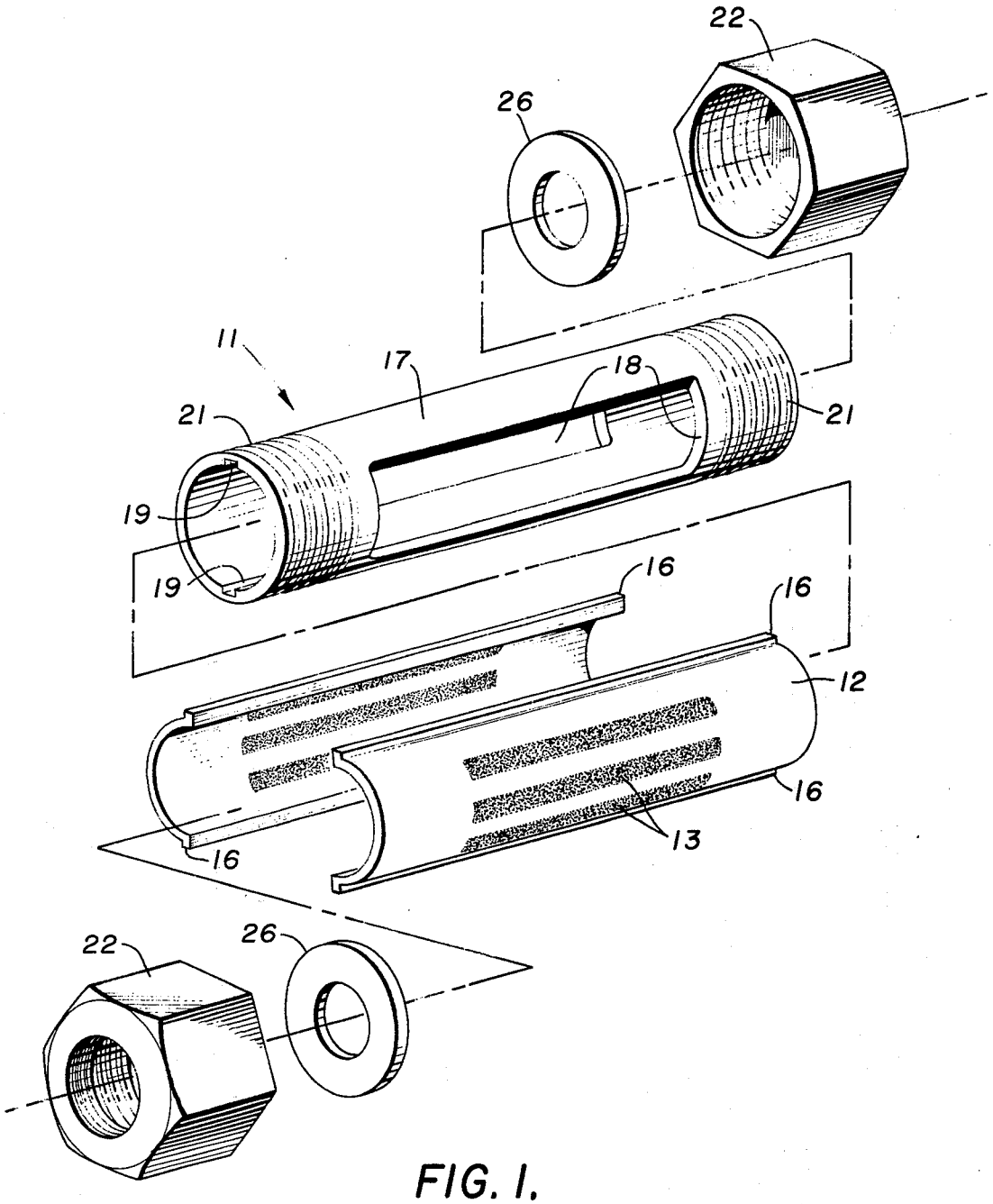
FIG. 1 is an exploded view of the spinnerette assembly of this invention showing the relationship of the various parts.
Figure 2:
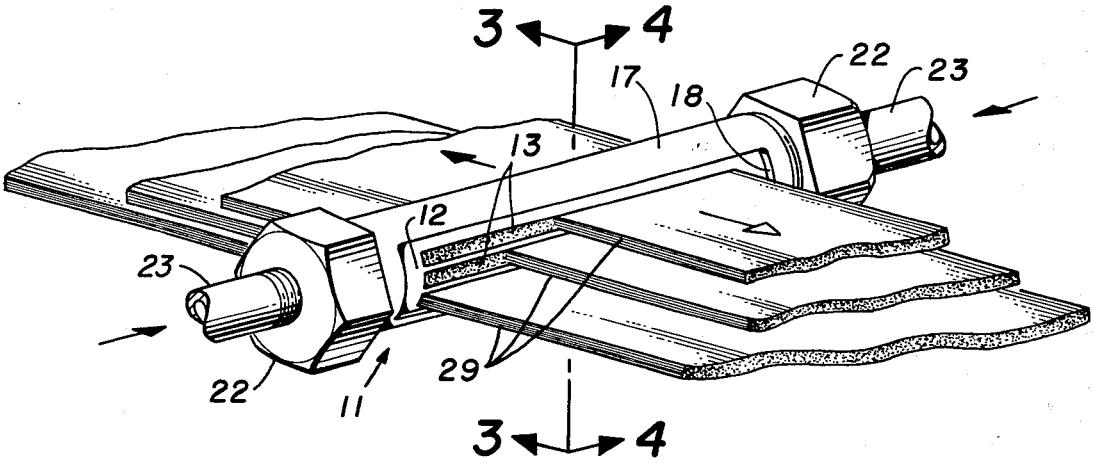
FIG. 2 is a perspective view showing bundles of fibers being formed by the spinnerette assembly.
Figure 3:
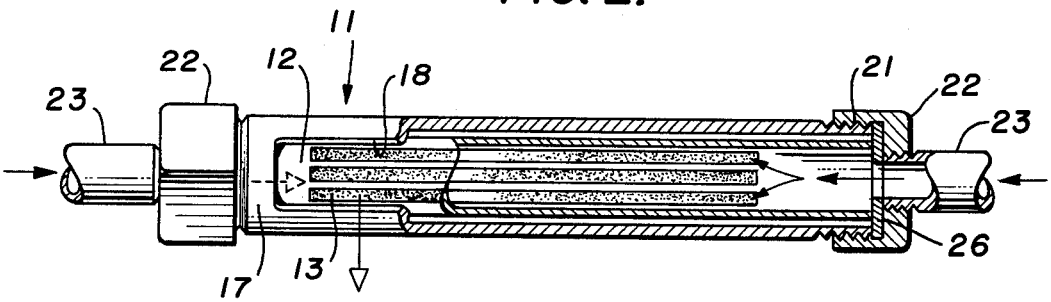
FIG. 3 is a front view of the spinnerette assembly with portions broken away to show the manner in which the various parts are secured together.

Referring now in detail to the drawings, there is shown a spinnerette assembly 11 having a tubular spinning element 12 which is provided with a plurality of spaced arrays 13 of spinning orifices (not shown), each array 13 being made up of a large number of spinning orifices of a type suitable for spinning textile filaments. Preferably, each of the arrays 13 has a rectangular configuration, with the long axis of the rectangle extending along the element 12. The element 12 may be made by punching or drilling conventional spinning orifices in a flat sheet and then forming the sheet into a semi-cylindrical configuration as best shown in FIG. 1. By providing the sheet with flanges 16 two of these sheets can be joined together to form a tubular element, this being accomplished by securing the flanges 16 together in a suitable manner.

The spinning element is positioned inside a tubular support member 17 having openings or slots 18 positioned to expose the arrays 13 of spinning orifices. The purpose of the member 17 is to support and position the spinning element 12 and to provide a portion of the structure which serves to seal the ends of the element 12 from leakage. The member 17 is provided with longitudinal internal grooves 19 (FIG. 1) in which the flanges 16 on the element 12 are positioned. This prevents movement of the element 12.

The ends of the support member 17 are provided with threaded portions 21 which fit into the end of conventional fittings 22 used to secure inlet lines 23 to the spinnerette assembly. Gaskets 26 positioned between the ends of the member 17 and the fittings 22 serve to prevent leakage of a spinning composition entering the assembly axially through supply lines 23. It will be noted that the spinning element 12 is slightly longer than the member 17 so that the ends of the element 12 are forced into the gaskets 26 to insure an adequate seal at each end of the element 12.

Figure 4:
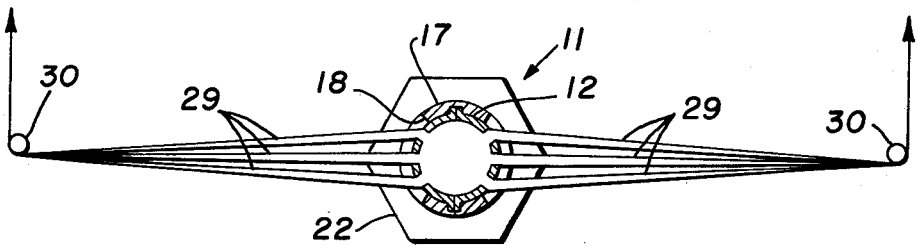
FIG. 4 is an end view of the spinnerette assembly showing the direction in which filaments leave the assembly.

In operation of the spinnerette assembly, a spinning composition is fed axially into the assembly through the inlet or supply lines 23. The spinning composition passes through the spinning orifices in directions radial to the axis of assembly and is thereby formed into filaments. Because of the rectangular configuration of the arrays 13, the filaments leaving the assembly make up flat bundles 29. The bundles 29 can be combined and passed over guides 30 (FIG. 4) for further processing.

It will readily be recognized that this spinnerette assembly has several advantages. First, the problem of spinnerette bulging is solved. Second, production rate may be significantly improved because of the fact that a spinnerette assembly of this type can be provided with many more spinning orifices than can a conventional spinnerette. Finally, the spinning arrays 13 may be rectangular in configuration so that the bundles of filaments leaving the spinnerette assembly have a rectangular cross-sectional configuration. Since the bundle begins with a rectangular configuration, there is no need for further manipulation of the tow bundle to form it into a rectangular configuration for subsequent treatment, as is necessary with a conventional spinnerette.

What is claimed is:

1. A spinnerette assembly, comprising a. a tubular spinning element having therein a plurality of spinning orifices positioned in rectangular arrays extending along the spinning element, said spinning element also having flange means extending along the length thereof, b. a tubular support member enclosing the spinning element and having therein internal groove means for receiving the flange means on the spinning element to prevent relative movement of said element and said member, said support member also having therein elongated slot means positioned to expose the arrays of spinning orifices in the spinning element, c. inlet line means positioned to feed a spinning composition axially into the spinnerette assembly, d. gasket means positioned between the spinning element and the inlet line means, and e. means for securing the inlet line means to the support member.

* * * * *